US010920304B2

(12) United States Patent
Ohata et al.

(10) Patent No.: US 10,920,304 B2
(45) Date of Patent: Feb. 16, 2021

(54) CEMENTED CARBIDE AND ITS PRODUCTION METHOD, AND ROLLING ROLL

(71) Applicant: HITACHI METALS, LTD., Tokyo (JP)

(72) Inventors: Takumi Ohata, Kitakyusyu (JP); Shunji Matsumoto, Kitakyusyu (JP)

(73) Assignee: HITACHI METALS, LTD., Tokyo (JP)

( * ) Notice: Subject to any disclaimer, the term of this patent is extended or adjusted under 35 U.S.C. 154(b) by 212 days.

(21) Appl. No.: 16/322,231

(22) PCT Filed: Aug. 1, 2017

(86) PCT No.: PCT/JP2017/027861
§ 371 (c)(1),
(2) Date: Jan. 31, 2019

(87) PCT Pub. No.: WO2018/025848
PCT Pub. Date: Feb. 8, 2018

(65) Prior Publication Data

US 2019/0194783 A1 Jun. 27, 2019

(30) Foreign Application Priority Data

Aug. 1, 2016 (JP) ..... JP2016-151140

(51) Int. Cl.
*C22C 29/08* (2006.01)
*B21B 27/03* (2006.01)
(Continued)

(52) U.S. Cl.
CPC ..... *C22C 29/08* (2013.01); *B21B 27/00* (2013.01); *B22F 3/1021* (2013.01);
(Continued)

(58) Field of Classification Search
None
See application file for complete search history.

(56) References Cited

U.S. PATENT DOCUMENTS 4,401,297 A * 8/1983 Doi ..... F27B 5/00 266/252
6,258,147 B1 7/2001 Jansson et al.
2005/0044987 A1* 3/2005 Takayama ..... B22F 7/04 75/236

FOREIGN PATENT DOCUMENTS

JP 58-110655 A 7/1983
JP 05-171339 A 7/1993
(Continued)

OTHER PUBLICATIONS

International Search Report for PCT/JP2017/027861 dated Sep. 5, 2017 [PCT/ISA/210].
(Continued)

*Primary Examiner* — George Wyszomierski
(74) *Attorney, Agent, or Firm* — Sughrue Mion, PLLC

(57) ABSTRACT

A cemented carbide comprising 55-90 parts by mass of WC particles, and 10-45 parts by mass of an Fe-based binder phase, the binder phase having a composition comprising 2.5-10% by mass of Ni, 0.2-1.2% by mass of C, 0.5-5% by mass of Cr, 0.2-2.0% by mass of Si, 0.1-3% by mass of W, 0-5% by mass of Co, and 0-1% by mass of Mn, the balance being substantially Fe and inevitable impurities, and the cemented carbide being substantially free from composite carbides having major axes of 5 μm or more. This cemented carbide is produced by cooling at a cooling rate of 60° C./hour or more between 900° C. and 600° C., after vacuum sintering.

9 Claims, 2 Drawing Sheets

(51) Int. Cl.

| | |
|---|---|
| ***B22F 3/10*** | (2006.01) |
| ***C22C 1/05*** | (2006.01) |
| ***B21B 27/00*** | (2006.01) |

(52) U.S. Cl.
CPC ..... *B22F 3/1035* (2013.01); *C22C 1/05* (2013.01); *C22C 1/051* (2013.01); *B21B 27/03* (2013.01)

(56) References Cited

FOREIGN PATENT DOCUMENTS

| | | | |
|---|---|---|---|
| JP | 10-053832 | A | 2/1998 |
| JP | 2000-219931 | A | 8/2000 |
| JP | 2001-081526 | A | 3/2001 |
| JP | 2003-342668 | A | 12/2003 |
| JP | 2004-148321 | A | 5/2004 |
| JP | 2004-255401 | A | 9/2004 |
| JP | 2005-076115 | A | 3/2005 |
| JP | 2006-289430 | A | 10/2006 |
| JP | 2007-092090 | A | 4/2007 |

OTHER PUBLICATIONS

Communication dated Nov. 19, 2019 from European Patent Office in counterpart EP Application No. 17836952.6.

* cited by examiner

CEMENTED CARBIDE AND ITS PRODUCTION METHOD, AND ROLLING ROLL

CROSS REFERENCE TO RELATED APPLICATIONS

This application is a National Stage of International Application No. PCT/JP2017/027861 filed Aug. 1, 2017, claiming priority based on Japanese Patent Application No. 2016-151140 filed Aug. 1, 2016.

FIELD OF THE INVENTION

The present invention relates to a cemented carbide comprising an iron alloy having excellent wear resistance and high compressive yield strength as a binder phase, and its production method, and an outer layer made of such cemented carbide for a rolling roll.

BACKGROUND OF THE INVENTION

Because cemented carbides obtained by sintering WC particles with Co—Ni—Cr-based binder phases have high hardness and mechanical strength and excellent wear resistance, they are widely used for cutting tools, rolling rolls, etc.

For example, JP 5-171339 A discloses a WC—Co—Ni—Cr cemented carbide comprising 95% or less by mass of WC+Cr, and less than 10% by mass of Co+Ni, Cr/(Co+Ni+Cr) being 2-40%. JP 5-171339 A describes that because cemented carbide having such composition has higher wear resistance and toughness than those of cemented carbides having conventional compositions, the use of such cemented carbide for hot-rolling rolls and guide rollers makes significant contribution to rolling cost reduction such as an increased rolling amount per caliber, decreased regrinding and breakage, etc. However, a rolling roll made of cemented carbide composed of WC particles and a Co—Ni—Cr binder phase fails to conduct sufficient cold rolling of a steel strip. Intensive research has revealed that because a cemented carbide having a Co—Ni—Cr binder phase has as low compressive yield strength as 300-500 MPa, the rolling surface is so yielded during cold rolling that a steel strip is not sufficiently compressed, resulting in insufficient cold rolling.

JP 2000-219931 A discloses a cemented carbide comprising 50-90% by mass of submicron WC in a binder phase having hardenability; the binder phase comprising, in addition to Fe, 10-60% by mass of Co, less than 10% by mass of Ni, 0.2-0.8% by mass of C, and further Cr and W and optional Mo and/or V; the molar ratios $X_C$, $X_{Cr}$, $X_W$, $X_{Mo}$ and $X_V$ of C, Cr, W, Mo and V in the binder phase meeting the condition of $2X_C<X_W+X_{Cr}+X_{Mo}+X_V<2.5X_C$; and the amount of Cr (% by mass) meeting 0.03<Cr/[100−WC (% by mass)]<0.05. JP 2000-219931 A describes that because of the binder phase having hardenability, this cemented carbide has high wear resistance. However, it has been found that because the binder phase contains 10-60% by mass of Co, this cemented carbide has low hardenability, failing to exhibit sufficient compressive yield strength. It has further been found that because WC particles are as small as submicrons, this cemented carbide has poor toughness and cracking resistance, failing to be used for outer layers of rolling rolls.

JP 2001-81526 A discloses an iron-based cemented carbide comprising 50-97% by mass of WC, the balance being an Fe-based binder phase, the binder phase containing 0.35-3.0% by mass of C, 3.0-30.0% by mass of Mn, and 3.0-25.0% by mass of Cr. JP 2001-81526 A describes that the martensitic transformation of Fe provides the iron-based cemented carbide with improved hardness and strength, and excellent wear resistance and corrosion resistance. In this iron-based cemented carbide, part or all of Mn in the Fe-based binder phase may be substituted by Ni, Example Nos. 14 and 16 containing 4% by mass of Ni. However, because the binder phases of Nos. 14 and 16 containing Ni also contain Mn contributing to the stabilization of austenite in amounts of 8% by mass and 10% by mass, respectively, the iron-based cemented carbide contains an excessive amount of residual austenite, failing to exhibit sufficient compressive yield strength.

JP 2004-148321 A discloses a hot-rolling composite roll comprising a steel shaft and an outer layer formed around the steel shaft; the outer layer being obtained by sintering 10-50% by mass of carbide and/or nitride powder of Ti, Zr, Hf, V, Nb, Ta, Cr, Mo or W with iron-based powder; the iron-based powder comprising one or more of 0.5-1.5% by mass of C, 0.1-2.0% by mass of Si, 0.1-2.0% by mass of Mn, 0.1-2% by mass of Ni, 0.5-10% by mass of Cr, and 0.1-2% by mass of Mo, the balance being Fe and inevitable impurities; and the hot-rolling composite roll having a diameter of 250-620 mm, and Young's modulus of 240 GPa or more, as well as excellent wear resistance and strength. JP 2004-148321 A describes that this hot-rolling composite roll can conduct high-reduction rolling, with improved rolled product quality. However, because the iron-based powder generally described in the specification of JP 2004-148321 A has a composition containing as little as 0.1-2% by mass of Ni, the binder phase in the outer layer does not have sufficient hardenability. Also, because the amount of carbide and/or nitride powder of Ti, Zr, Hf, V, Nb, Ta, Cr, Mo or W is 10-50% by mass, half or less of the entire cemented carbide, a phase made from the iron-based powder being a main phase, this outer layer does not have sufficient wear resistance, so that it exhibits poor performance as a rolling roll material.

JP 10-53832 A discloses a cemented carbide comprising 50-70% by weight of WC and 50-30% by weight of an Fe—C binder phase, the C content in the binder phase being more than 0.8% by weight and less than 2.0% by weight. However, this cemented carbide does not have sufficient hardenability, because it does not contain Ni.

JP 2005-76115 A discloses an iron-containing cemented carbide comprising 1-30% by weight of an iron-based metal binder phase, the balance being a hard phase of at least one of carbides, nitrides and their solid solutions of metals in the Groups 4a, 5a and 6a in the Periodic Table; the metal binder phase containing 1-20% by weight of copper. The metal binder phase may contain, in addition to iron and copper, at least one of tungsten, chromium, molybdenum, manganese, nickel and cobalt at a percentage of 20% or less by weight of the entire metal binder phase. The metal binder phase is specifically an Fe—Cu alloy, an Fe—Cu—Cr alloy, an Fe—Cu—Mn alloy, an Fe—Cu—Cr—Ni—Cr—Mo alloy, etc. However, this iron-containing cemented carbide does not have sufficient compressive yield strength, because the metal binder phase contains 1-20% by weight of copper.

JP 58-110655 A discloses a cemented carbide composition comprising ultrahigh-heat-resistance tungsten carbide particles and a metal matrix binder; the matrix binder occupying 3-20% by mass of the composition; and the matrix binder being made of an alloy comprising about 5-50% by mass of nickel, and up to 2% by mass of carbon sufficient for preventing the formation of harmful carbon-depleted phase or carbon-excessive phase, the balance being 99-50% by mass of iron. In Examples, the nickel content is 20-50% by weight. However, because 20-50% by weight of nickel stabilizes an austenite phase, thereby lowering the hardenability, the cemented carbide composition does not have sufficient compressive yield strength. In addition, the matrix of this cemented carbide composition is not fully strengthened because it does not contain 0.2-2.0% by mass of Si, and further does not have sufficient compressive yield strength when it contains copper.

In view of the above circumstances, a cemented carbide comprising an Fe-based binder phase for exhibiting sufficient compressive yield strength, which makes it unlikely to generate dents on the rolling surface due to yield even when used for the cold rolling of a metal strip, is desired.

OBJECT OF THE INVENTION

Accordingly, an object of the present invention is to provide a cemented carbide having high wear resistance and mechanical strength and sufficient compressive yield strength, and its production method.

Another object of the present invention is to provide a cemented-carbide-made rolling roll suffering no dents on its rolling surface when used for the cold rolling of a metal strip.

DISCLOSURE OF THE INVENTION

In view of the problems of the above conventional technologies, with respect to a cemented carbide having an Fe-based binder phase, the inventor has conducted intensive investigation on the composition and structure of the binder phase, thereby conceiving the present invention.

Thus, the cemented carbide of the present invention comprises 55-90 parts by mass of WC particles, and 10-45 parts by mass of a binder phase containing Fe as a main component (Fe-based binder phase), the binder phase having a composition comprising 2.5-10% by mass of Ni,
0.2-1.2% by mass of C,
0.5-5% by mass of Cr,
0.2-2.0% by mass of Si,
0.1-3% by mass of W,
0-5% by mass of Co, and
0-1% by mass of Mn, the balance being substantially Fe and inevitable impurities, and the cemented carbide being substantially free from composite carbides having major axes of 5 μm or more.

The WC particles preferably have a median diameter D50 of 2-10 μm.

The inevitable impurities in the binder phase are at least one selected from the group consisting of Mo, V, Nb, Ti, Al, Cu, N and O. Among them, the amount of at least one selected from the group consisting of Mo, V and Nb is preferably 2% or less by mass in total, and the amount of at least one selected from the group consisting of Ti, Al, Cu, N and O is preferably 0.5% or less by mass each and 1% or less by mass in total.

The amount of a bainite phase and/or a martensite phase in the binder phase is preferably 50% or more by area in total.

The cemented carbide preferably has compressive yield strength of 1200 MPa or more.

The method of the present invention for producing the above cemented carbide comprises press-molding a mixture comprising 55-90 parts by mass of WC powder, and 10-45 parts by mass of metal powder comprising 2.5-10% by mass of Ni, 0.3-1.7% by mass of C, 0.5-5% by mass of Cr, 0.2-2.0% by mass of Si, 0-5% by mass of Co, and 0-1% by mass of Mn, the balance being Fe and inevitable impurities;

vacuum-sintering the resultant green body at a temperature from its liquid phase generation start temperature to the liquid phase generation start temperature+100° C.; and then cooling the resultant sintered body at a cooling rate of 60° C./hour or more between 900° C. and 600° C.

The rolling composite roll of the present invention comprises an outer layer made of the above cemented carbide, the outer layer being metallurgically bonded to a peripheral surface of a steel sleeve or shaft.

Effects of the Invention

Because a roll made of the cemented carbide of the present invention suffers less small dents due to compressive yield on the rolling surface even when used for the cold rolling of a metal (steel) strip, the high-quality cold rolling of a steel strip can be conducted continuously with a longer life.

DESCRIPTION OF THE PREFERRED EMBODIMENTS

Figure 1:
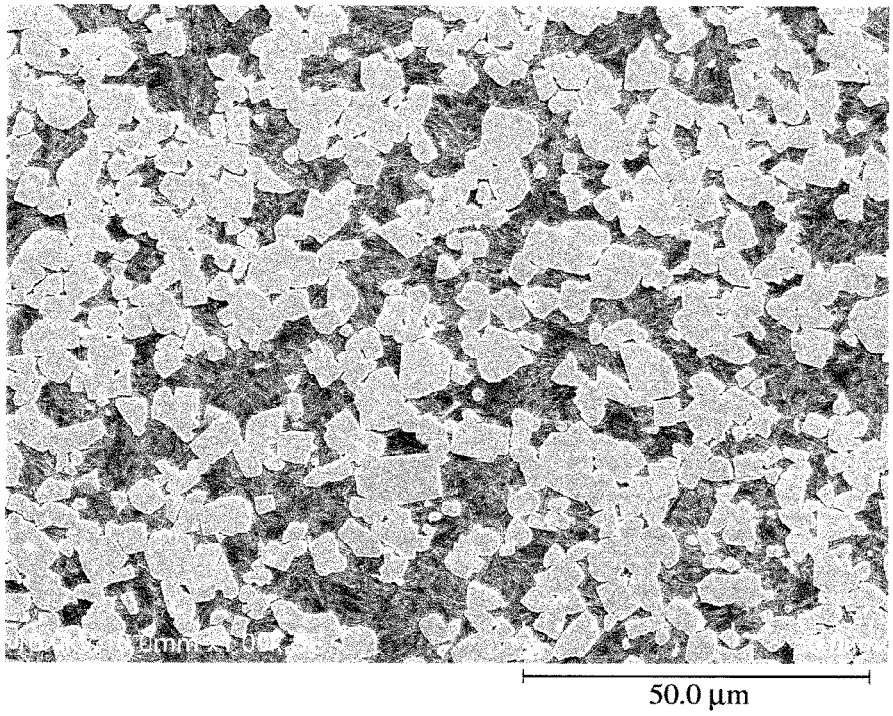
FIG. 1 is a SEM photograph showing a cross section structure of the cemented carbide of Sample 2.

The embodiments of the present invention will be described in detail below, and it should be noted that explanations of one embodiment are applicable to other embodiments unless otherwise mentioned, and that the following explanations are not restrictive but may be modified within the scope of the present invention.

[1] Cemented Carbide (A) Composition

The cemented carbide of the present invention comprises 55-90 parts by mass of WC particles, and 10-45 parts by mass of an Fe-based binder phase.

(1) WC Particles

The cemented carbide of the present invention contains 55-90 parts by mass of WC particles. When the WC particles are less than 55 parts by mass, the cemented carbide exhibits too low a Young's modulus because of a relatively low percentage of hard WC particles. On the other hand, when the WC particles exceed 90 parts by mass, the cemented carbide does not have enough strength because of a relatively low percentage of the binder phase. The lower limit of the amount of WC particles is preferably 60 parts by mass, more preferably 65 parts by mass. The upper limit of the amount of WC particles is preferably 85 parts by mass.

WC particles preferably have a median diameter D50 (corresponding to a particle size at a cumulative volume of 50%) of 2-10 μm. When the median particle size is less than 2 μm, composite carbides are likely formed because of increased boundaries between WC particles and the binder phase. On the other hand, when the median particle size is more than 10 μm, the cemented carbide has low strength. The lower limit of the median diameter D50 of WC particles is preferably 4 μm, more preferably 5 μm, most preferably 6 μm. The upper limit of the median diameter D50 of WC particles is preferably 9 μm, more preferably 8 μm, most preferably 7 μm.

Because WC particles are clustered in the cemented carbide, it is difficult to measure the particle sizes of WC particles on a photomicrograph. In the case of the cemented carbide of the present invention, a green body is sintered in vacuum at a temperature from (liquid phase generation start temperature) to (liquid phase generation start temperature+100° C.) as described below, resulting in substantially no difference in particle size between WC powder in the raw material and WC particles in the cemented carbide. Accordingly, the particle size of WC particles dispersed in the cemented carbide is expressed by the particle size of WC powder in the raw material.

WC particles preferably have relatively uniform particle sizes. To this end, in a cumulative particle size distribution curve determined by a laser diffraction and scattering method, the particle size distribution of WC particles has preferably D10 (particle size at a cumulative volume of 10%) of 1-5 μm, a median diameter D50 of 5-8 μm, and D90 (particle size at a cumulative volume of 90%) of 8-12 μm, more preferably D10 of 3-5 μm, D50 of 6-7 μm, and D90 of 9-10 μm.

(2) Binder Phase

In the cemented carbide of the present invention, the binder phase has a composition comprising 2.5-10% by mass of Ni,
0.2-1.2% by mass of C,
0.5-5% by mass of Cr,
0.2-2.0% by mass of Si,
0.1-3% by mass of W,
0-5% by mass of Co, and
0-1% by mass of Mn, the balance being substantially Fe and inevitable impurities.

(i) Indispensable Elements (a) Ni: 2.5-10% by Mass

Ni is an element necessary for securing the hardenability of the binder phase. When Ni is less than 2.5% by mass, the binder phase has insufficient hardenability, failing to provide the cemented carbide with sufficient compressive yield strength. On the other hand, when Ni is more than 10% by mass, the binder phase is austenized, resulting in low hardenability, also failing to provide the cemented carbide with sufficient compressive yield strength. The lower limit of the Ni content is preferably 3% by mass, more preferably 4% by mass. Also, the upper limit of the Ni content is preferably 8% by mass, more preferably 7% by mass.

(b) C: 0.2-1.2% by Mass

C is an element necessary for securing the hardenability of the binder phase, and for preventing the formation of coarse composite carbides. When C is less than 0.2% by mass, the binder phase has too low hardenability. On the other hand, when C is more than 1.2% by mass, coarse composite carbides are formed, providing the cemented carbide with low strength. The lower limit of the C content is preferably 0.3% by mass, more preferably 0.5% by mass. Also, the upper limit of the C content is preferably 1.1% by mass, more preferably 1.0% by mass.

(c) Cr: 0.5-5% by Mass

Cr is an element necessary for securing the hardenability of the binder phase. When Cr is less than 0.5% by mass, the binder phase has too low hardenability, failing to provide sufficient compressive yield strength. On the other hand, when Cr is more than 5% by mass, coarse composite carbides are formed, providing the cemented carbide with low strength. Cr is preferably 4% or less by mass, more preferably 3% or less by mass.

(d) Si: 0.2-2.0% by Mass

Si is an element necessary for strengthening the binder phase. When Si is less than 0.2% by mass, the binder phase is not sufficiently strengthened. On the other hand, when Si, a graphitizing element, is more than 2.0% by mass, graphite is likely precipitated, lowering the strength of the cemented carbide. The lower limit of the Si content is preferably 0.3% by mass, more preferably 0.5% by mass. Also, the upper limit of the Si content is preferably 1.9% by mass.

(e) W: 0.1-3% by Mass

W dissolved from WC particles into the binder phase by sintering is contained at a percentage of 0.1-3% by mass in the binder phase. When the W content in the binder phase is more than 3% by mass, coarse composite carbides are formed, providing the cemented carbide with low strength. The lower limit of the W content is preferably 0.8% by mass, more preferably 1.2% by mass.

Also, the upper limit of the W content is preferably 2.5% by mass.

(ii) Optional Elements (a) Co: 0-5% by Mass

Co has a function of improving sinterability, but it is not indispensable for the cemented carbide of the present invention. The Co content is preferably substantially 0% by mass, but 5% or less by mass of Co would not adversely affect the structure and strength of the cemented carbide of the present invention. The upper limit of the Co content is more preferably 2% by mass, most preferably 1% by mass.

(b) Mn: 0-1% by Mass

Mn has a function of improving hardenability, but it is not indispensable for the cemented carbide of the present invention. The Mn content is preferably substantially 0% by mass, but 1% or less by mass of Mn would not adversely affect the structure and strength of the cemented carbide of the present invention. The upper limit of the Mn content is more preferably 0.5% by mass, most preferably 0.3% by mass.

(iii) Inevitable Impurities

Inevitable impurities include Mo, V, Nb, Ti, Al, Cu, N, 0, etc.

Among them, at least one selected from the group consisting of Mo, V and Nb is preferably 2% or less by mass in total. The amount of at least one selected from the group consisting of Mo, V and Nb is more preferably 1% or less by mass, most preferably 0.5% or less by mass in total. Also, the amount of at least one selected from the group consisting of Ti, Al, Cu, N and O is preferably 0.5% or less by mass each and 1% or less by mass in total. Particularly, each of N and O is preferably less than 1000 ppm. As long as the amounts of inevitable impurities are within the above ranges, the structure and strength of the cemented carbide of the present invention are not substantially affected.

(B) Structure (1) Composite Carbides

The cemented carbide of the present invention has a structure substantially free from composite carbides having major axes of 5 μm or more.

The composite carbides are those composed of W and metal elements, for example, $(W, Fe, Cr)_{23}C_6$, $(W, Fe, Cr)_3C$, $(W, Fe, Cr)_2C$, $(W, Fe, Cr)_7C_3$, $(W, Fe, Cr)_6C$, etc.

The cemented carbide of the present invention is preferably substantially free from composite carbides having major axes of 5 μm or more. The major axis of each composite carbide is the maximum length (length of the longest straight line among those connecting two points on a periphery) of each composite carbide on a photomicrograph (magnification: 1000×) of a polished cross section of the cemented carbide. The cemented carbide free from composite carbides having major axes of 5 μm or more in the binder phase has bending strength of 1700 MPa or more. The term "substantially free from composite carbides" means that composite carbides having major axes of 5 μm or more are not observed on a SEM photograph (magnification: 1000×). Less than about 5% by area of composite carbides having major axes of less than 5 μm may exist in the cemented carbide of the present invention, when analyzed by EPMA.

(2) Bainite Phase and/or Martensite Phase

The binder phase in the cemented carbide of the present invention preferably has a structure comprising 50% or more by area in total of a bainite phase and/or a martensite phase. The term "bainite phase and/or martensite phase" is used because the bainite phase and the martensite phase have substantially the same function, and are difficult to be distinguished from each other on a photomicrograph. With such structure, the cemented carbide of the present invention has high compressive yield strength and mechanical strength.

Because the binder phase contains 50% or more by area in total of a bainite phase and/or a martensite phase, the cemented carbide of the present invention has compressive yield strength of 1200 MPa or more. The total amount of a bainite phase and/or a martensite phase is preferably 70% or more by area, more preferably 80% or more by area, most preferably substantially 100% by area. Other phases than the bainite phase and the martensite phase are a pearlite phase, an austenite phase, etc.

(3) Diffusion of Fe into WC Particles

EPMA analysis has revealed that in the sintered cemented carbide, 0.3-0.7% by mass of Fe exists in WC particles.

(C) Properties

Because the cemented carbide of the present invention having the above composition and structure has compressive yield strength of 1200 MPa or more and bending strength of 1700 MPa or more, a rolling roll having an outer layer made of the cemented carbide of the present invention does not suffer dents by compressive yield on the rolling surface, when used in the cold rolling of a metal strip (steel strip). Accordingly, the high-quality rolling of a metal strip can be continuously conducted, with a long life of the rolling roll. Of course, the cemented carbide of the present invention can be used for rolls for hot-rolling a metal strip.

Figure 2:
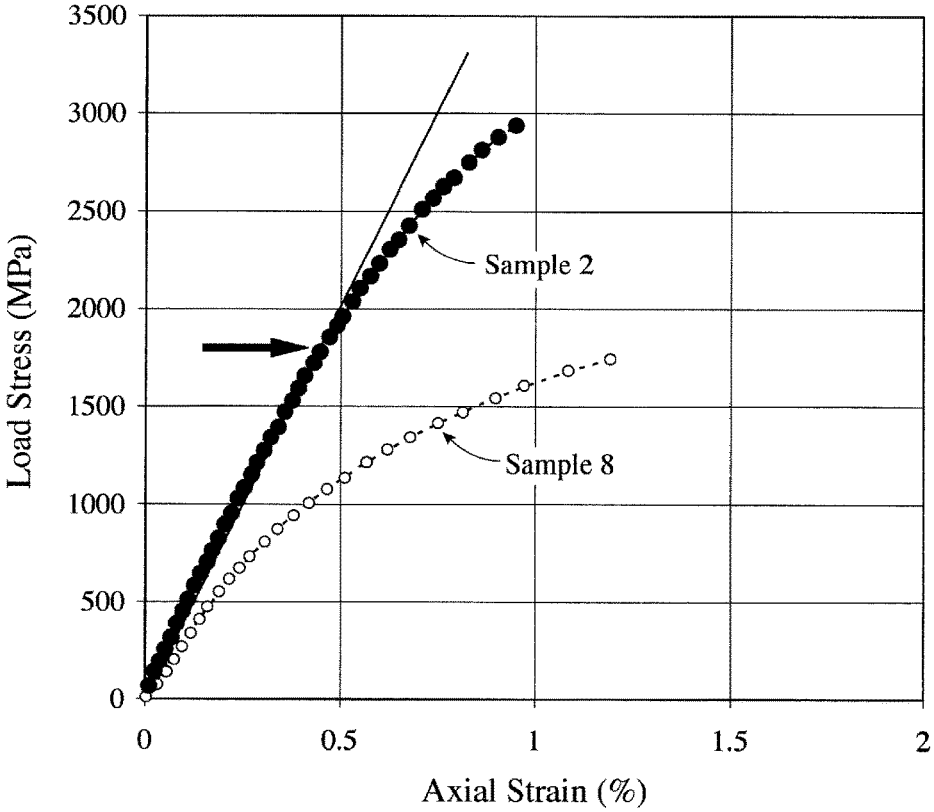
FIG. 2 is a graph showing stress-strain curves of Samples 2 and 8 measured by a uniaxial compression test.
Figure 3:
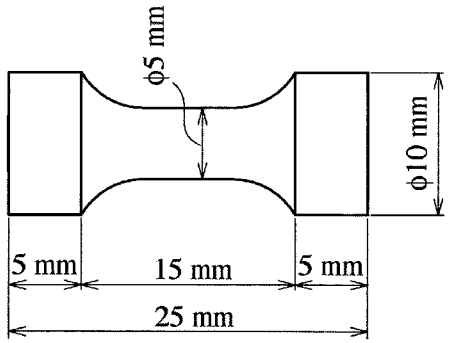
FIG. 3 is a schematic view showing a test piece used in the uniaxial compression test.

The compressive yield strength is a yield stress in a uniaxial compression test, in which a test piece shown in FIG. 3 receives an axial load. Namely, in a stress-strain curve of the uniaxial compression test as shown in FIG. 2, a stress at a point at which stress and strain deviate from a straight-line relation is defined as the compressive yield strength.

In the cemented carbide of the present invention, the compressive yield strength is more preferably 1500 MPa or more, most preferably 1600 MPa or more, and the bending strength is more preferably 2000 MPa or more, most preferably 2300 MPa or more.

The cemented carbide of the present invention further has a Young's modulus of 385 GPa or more and Rockwell hardness of 80 HRA or more. The Young's modulus is preferably 400 GPa or more, more preferably 450 GPa or more, and the Rockwell hardness is preferably 82 HRA or more.

[2] Production Method of Cemented Carbide (A) Raw Material Powder 55-90 parts by mass of WC powder was wet-mixed with 10-45 parts by mass of metal powder comprising 2.5-10% by mass of Ni, 0.3-1.7% by mass of C, 0.5-5% by mass of Cr, 0.2-2.0% by mass of Si, 0-5% by mass of Co, and 0-2% by mass of Mn, the balance being Fe and inevitable impurities, in a ball mill, etc., to prepare a raw material powder. Because W is diffused from WC powder into the binder phase during sintering, W need not be contained in the raw material powder. The WC powder content is preferably 60-90 parts by mass, more preferably 65-90 parts by mass. The upper limit of the WC powder content is preferably 85 parts by mass. To prevent the formation of composite carbides, the C content in the raw material powder is 0.3-1.7% by mass, preferably 0.5-1.5% by mass.

The metal powder for forming the binder phase may be a mixture of constituent element powders, or an alloyed powder of all constituent elements. Carbon may be in a powder form such as graphite, carbon black, etc., or may be added to powder of each metal or alloy. Cr may be added in the form of an alloy with Si (for example, $CrSi_2$). The median diameter D50 of powder of each metal or alloy, for example, Fe powder, Ni powder, Co powder, Mn powder, and $CrSi_2$ powder, is preferably 1-10 μm.

(B) Press-Molding

The raw material powder is dried, and then press-molded to a green body having a desired shape by a method such as die press molding, cold-isostatic pressing (CIP), etc.

(C) Sintering

Figure 4:
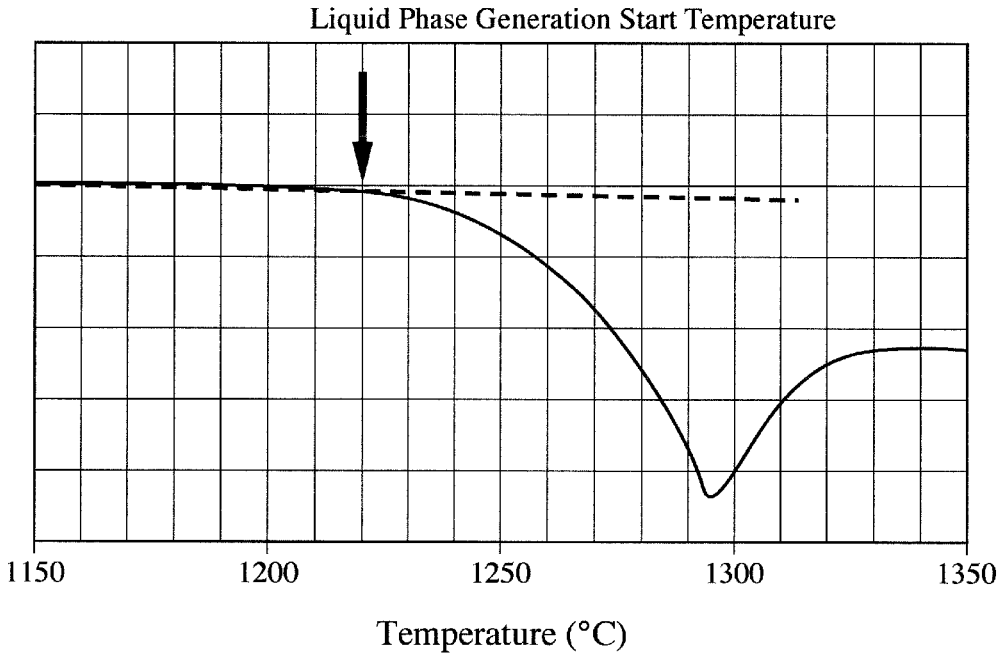
FIG. 4 is a graph showing an example of the measurements of a liquid phase generation start temperature by a differential thermal analyzer.

The green body is sintered at a temperature from (liquid phase generation start temperature) to (liquid phase generation start temperature+100° C.) in vacuum. The liquid phase generation start temperature of the green body is a temperature at which a liquid phase starts to be generated during temperature elevation in the sintering step, measured by a differential thermal analyzer. FIG. 4 shows an example of the measurement results. As shown by the arrow in FIG. 4, the liquid phase generation start temperature of the green body is a temperature at which an endothermic reaction starts. Sintering at a temperature exceeding the liquid phase generation start temperature+100° C. generates coarse composite carbides, providing the resultant cemented carbide with low strength. On the other hand, sintering at a temperature lower than the liquid phase generation start temperature leads to insufficient densification, providing the resultant cemented carbide with low strength. The lower limit of the sintering temperature is preferably the liquid phase generation start temperature+10° C., and the upper limit of the sintering temperature is preferably the liquid phase generation start temperature+90° C., more preferably the liquid phase generation start temperature+80° C. The resultant sintered body is preferably subjected to HIP.

(D) Cooling

The sintered body is cooled at an average cooling rate of 60° C./hour or more between 900° C. and 600° C. Cooling at an average cooling rate of less than 60° C./hour increases the percentage of a pearlite phase in the binder phase of the cemented carbide, failing to obtain 50% or more in total by area of a bainite phase and/or a martensite phase, thereby providing the cemented carbide with low compressive yield strength. The sintered body can be cooled at an average cooling rate of 60° C./hour or more in the sintering furnace; or cooled in the sintering furnace, heated again to 900° C. or higher, and then cooled at an average cooling rate of 60° C./hour or more. In the case of conducting HIP, the above cooling may be conducted in a cooling step in the HIP furnace.

[3] Applications

The cemented carbide of the present invention is preferably used for an outer layer metallurgically bonded to a tough steel sleeve or shaft of a rolling composite roll. Because this outer layer of the rolling composite roll has high compressive yield strength, bending strength, Young's modulus and hardness, it is particularly suitable for the cold rolling of a metal strip (steel strip). The rolling composite roll of the present invention is preferably used as a work roll, in (a) a 6-high rolling mill comprising a pair of upper and lower work rolls for rolling a metal strip, a pair of upper and lower intermediate rolls for supporting the work rolls, and a pair of upper and lower backup rolls for supporting the intermediate rolls, or (b) a 4-high rolling mill comprising a pair of upper and lower work rolls for rolling a metal strip, and a pair of upper and lower backup rolls for supporting the work rolls. At least one stand of the above mill is preferably used in a tandem rolling mill comprising pluralities of rolling mill stands.

In addition, the cemented carbide of the present invention is widely used for wear-resistant tools, corrosion-resistant, wear-resistant parts, dies, etc., in which conventional cemented carbides are used.

The present invention will be explained in further detail by Examples below, without intention of restriction.

Example 1

WC powder having purity of 99.9%, and a median diameter D50 of 6.4 μm, D10 of 4.3 μm, D50 of 6.4 μm, and D90 of 9.0 μm measured by a laser diffraction particle size analyzer (SALD-2200 available from Shimadzu Corporation) was mixed with a binder phase powder formulated to the composition shown in Table 1 at a ratio shown in Table 2, to prepare mixture powders (Samples 1-10). Each binder phase powder had a median diameter D50 of 1-10 μm, containing trace amounts of inevitable impurities.

Each mixture powder was wet-mixed for 20 hours in a ball mill, dried, and press-molded at pressure of 98 MPa to obtain cylindrical green bodies (Samples 1-10) of 60 mm in diameter and 40 mm in height. A sample of 1 mm×1 mm×2 mm was cut out of each green body, to measure its liquid phase generation start temperature by a differential thermal analyzer. The results are shown in Table 3.

TABLE 1

| Sample | Composition of Binder Phase Powder (% by mass) | | | | | | | | |
|---|---|---|---|---|---|---|---|---|---|
| No. | Si | Mn | Ni | Cr | Mo | V | C | Co | Fe[(1)] |
| 1 | 0.80 | — | 5.02 | 1.21 | — | — | 1.29 | — | Bal. |
| 2 | 0.80 | — | 5.02 | 1.21 | — | — | 1.29 | — | Bal. |
| 3 | 0.81 | — | 5.05 | 1.21 | — | — | 0.79 | — | Bal. |
| 4 | 1.61 | — | 5.02 | 2.41 | — | — | 1.27 | — | Bal. |
| 5 | 0.80 | — | 5.02 | 4.02 | — | — | 1.26 | — | Bal. |
| 6 | 0.80 | — | 2.61 | 3.52 | — | — | 1.29 | — | Bal. |
| 7* | 0.92 | 0.45 | 0.17 | 5.13 | 1.31 | 0.88 | 0.71 | — | Bal. |
| 8* | — | — | 5.43 | — | — | — | 1.30 | — | Bal. |
| 9* | 0.80 | — | 5.00 | 2.40 | — | — | 1.77 | — | Bal. |
| 10* | — | — | 31.13 | 6.67 | — | — | — | Bal. | — |

Note:
*Comparative Example.
(1)"Bal." includes inevitable impurities.

TABLE 2

| Sample No. | WC Powder (parts by mass) | Binder Phase Powder (parts by mass) |
|---|---|---|
| 1 | 80 | 20 |
| 2 | 70 | 30 |
| 3 | 70 | 30 |
| 4 | 70 | 30 |
| 5 | 70 | 30 |
| 6 | 70 | 30 |
| 7* | 70 | 30 |
| 8* | 70 | 30 |
| 9* | 70 | 30 |
| 10* | 85 | 15 |

Note:
*Comparative Example.

TABLE 3

| Sample No. | Liquid Phase Generation Start Temperature |
|---|---|
| 1 | 1210° C. |
| 2 | 1210° C. |
| 3 | 1230° C. |
| 4 | 1210° C. |
| 5 | 1210° C. |
| 6 | 1210° C. |
| 7* | 1160° C. |
| 8* | 1220° C. |
| 9* | 1200° C. |
| 10* | 1310° C. |

Note:
*Comparative Example.

The green bodies were vacuum-sintered under the conditions shown in Table 4, and subjected to HIP under the conditions shown in Table 4 to produce cemented carbides [Samples 1-6 (the present invention), and Samples 7-10 (Comparative Examples)]. Each cemented carbide was elevated by the following method.

TABLE 4

| | Vacuum Sintering | | HIP | | Cooling Average |
|---|---|---|---|---|---|
| Sample No. | Sintering Temperature (° C.) | Holding Time (hour) | Temperature (° C.) | Holding Time (hour) | Cooling Rate[(1)] (° C./hour) |
| 1 | 1260 | 2 | 1230 | 2 | 100 |
| 2 | 1260 | 2 | 1230 | 2 | 100 |
| 3 | 1280 | 2 | 1230 | 2 | 100 |
| 4 | 1260 | 2 | 1230 | 2 | 100 |
| 5 | 1260 | 2 | 1230 | 2 | 100 |
| 6 | 1260 | 2 | 1230 | 2 | 100 |
| 7* | 1350 | 2 | 1230 | 2 | 100 |
| 8* | 1330 | 2 | 1230 | 2 | 100 |
| 9* | 1260 | 2 | 1230 | 2 | 100 |
| 10* | 1400 | 2 | 1350 | 2 | 100 |

Note:
*Comparative Example.
(1)Average cooling rate between 900° C. and 600° C.

(1) Compressive Yield Strength

With a strain gauge attached to a surface of a center portion of each compression test piece shown in FIG. 3, which was cut out of each cemented carbide, an axial load was applied to the test piece to generate a stress-strain curve. In the stress-strain curve, stress at a point at which stress and strain deviated from a straight-line relation was regarded as compressive yield strength. The results are shown in Table 5.

(2) Bending Strength

A test piece of 4 mm×3 mm×40 mm was cut out of each cemented carbide, and measured with respect to bending strength under a four-point bending test conditions with a fulcrum distance of 30 mm. The results are shown in Table 5.

(3) Young's Modulus

A test piece of 10 mm in width, 60 mm in length and 1.5 mm in thickness was cut out of each cemented carbide, and measured by a free-resonance, intrinsic vibration method (JIS Z2280). The results are shown in Table 5.

(4) Hardness

Each cemented carbide was measured with respect to Rockwell hardness (A scale). The results are shown in Table 5.

TABLE 5

| Sample No. | Compressive Yield Strength (MPa) | Bending Strength (MPa) | Young's Modulus (GPa) | Hardness (HRA) |
|---|---|---|---|---|
| 1 | 1780 | 2574 | 534 | 86.1 |
| 2 | 1800 | 2714 | 496 | 84.4 |
| 3 | 1550 | 2490 | 496 | 84.2 |
| 4 | 1720 | 2126 | 496 | 84.3 |
| 5 | 1700 | 1766 | 496 | 82.6 |
| 6 | 2000 | 2019 | 496 | 85.1 |
| 7* | 2200 | 1470 | 494 | 85.1 |
| 8* | 300 | 1786 | 496 | 79.4 |
| 9* | 1680 | 1430 | 496 | 84.2 |
| 10* | 400 | 2580 | 535 | 84.2 |

Note:
*Comparative Example.

(5) Observation of Structure

Each sample was mirror-polished, and then observed by SEM to determine the presence or absence of composite carbides, and the total area ratio of a bainite phase and a martensite phase in the binder phase. The results are shown in Table 6. FIG. 1 is a SEM photograph of the cemented carbide of Sample 2. White particles are WC particles, and gray portions are a binder phase.

TABLE 6

| Sample No. | Bainite Phase and/or Martensite Phase(1) | Composite Carbides(2) |
|---|---|---|
| 1 | 50% or more by area | No |
| 2 | 50% or more by area | No |

TABLE 6-continued

| Sample No. | Bainite Phase and/or Martensite Phase(1) | Composite Carbides(2) |
|---|---|---|
| 3 | 50% or more by area | No |
| 4 | 50% or more by area | No |
| 5 | 50% or more by area | No |
| 6 | 50% or more by area | No |
| 7* | 50% or more by area | Yes |
| 8* | Less than 50% by area | No |
| 9* | 50% or more by area | Yes |
| 10* | Note Evaluated | No |

Note:
*Comparative Example.
(1)The total area ratio (%) of a bainite phase and a martensite phase in the binder phase.
(2)The presence or absence of composite carbides having diameters of 5 μm or more in the binder phase.

(6) Composition of Binder Phase

The composition of the binder phase of each sample was measured by a field-emission electron probe microanalyzer (FE-EPMA). Point analysis with a beam diameter of 1 μm was conducted at 10 arbitrary points in other portions than WC particles, and the measured values were averaged to determine the composition of the binder phase. When composite carbides having diameters of 5 μm or more existed, other portions than the WC particles and the composite carbides were measured. The results are shown in Table 7.

TABLE 7

| Sample | Composition of Binder Phase (% by mass)(1) | | | | | | | | | |
|---|---|---|---|---|---|---|---|---|---|---|
| No. | Si | Mn | Ni | Cr | W | Mo | V | C | Co | Fe(2) |
| 1 | 0.91 | — | 4.92 | 0.89 | 1.60 | — | — | 0.81 | — | Bal. |
| 2 | 0.93 | — | 4.89 | 0.94 | 1.63 | — | — | 0.83 | — | Bal. |
| 3 | 0.84 | — | 4.82 | 0.94 | 2.29 | — | — | 0.69 | — | Bal. |
| 4 | 1.84 | — | 4.84 | 1.75 | 1.47 | — | — | 0.74 | — | Bal. |
| 5 | 0.90 | — | 4.92 | 3.39 | 1.65 | — | — | 0.88 | — | Bal. |
| 6 | 0.84 | — | 2.60 | 2.82 | 1.70 | — | — | 0.88 | — | Bal. |
| 7* | 0.70 | 0.24 | 0.19 | 4.03 | 1.48 | 0.17 | 0.14 | 0.70 | — | Bal. |
| 8* | — | — | 4.83 | — | 1.15 | — | — | 0.31 | — | Bal. |
| 9* | 0.97 | — | 5.10 | 0.70 | 1.11 | — | — | 0.88 | — | Bal. |
| 10* | — | — | 31.27 | 6.53 | — | — | — | — | Bal. | — |

Note:
*Comparative Example.
(1)Analyzed value.
(2)"Bal." includes inevitable impurities.

Example 2

Using a raw material powder having the same composition as that of Sample 1 in Example 1, a cylindrical green body was produced by the same method as in Example 1. Each green body was sintered in the same manner as in Example 1, to produce an integral roll of 44 mm in outer diameter and 620 mm in length. When this roll was used for the cold rolling of a 0.6-mm-thick, pure-Ni strip, defects due to dents on the rolling surface were not generated on the pure-Ni strip.

Using a raw material powder having the same composition as that of Sample 10 (Comparative Example) in Example 1, an integral roll of 44 mm in outer diameter and 620 mm in length was similarly produced. When this roll was used for the rolling of a 0.6-mm-thick, pure-Ni strip, defects due to dents on the rolling surface were generated on the pure-Ni strip.

What is claimed is:

1. A cemented carbide comprising 55-90 parts by mass of WC particles, and 10-45 parts by mass of a binder phase containing Fe as a main component, said binder phase having a composition comprising 2.5-10% by mass of Ni, 0.2-1.2% by mass of C, 0.5-5% by mass of Cr, 0.2-2.0% by mass of Si, 0.1-3% by mass of W, 0-5% by mass of Co, and 0-1% by mass of Mn, the balance being substantially Fe and inevitable impurities; and said cemented carbide being substantially free from composite carbides having major axes of 5 μm or more.

2. The cemented carbide according to claim 1, wherein said WC particles have a median diameter D50 of 2-10 μm.

3. The cemented carbide according to claim 1, said inevitable impurities in said binder phase are at least one selected from the group consisting of Mo, V, Nb, Ti, Al, Cu, N and O.

4. The cemented carbide according to claim 1, wherein at least one selected from the group consisting of Mo, V and Nb in said inevitable impurities is 2% or less by mass in total.

5. The cemented carbide according to claim 4, wherein at least one selected from the group consisting of Ti, Al, Cu, N and O in said inevitable impurities is 0.5% or less by mass each and 1% or less by mass in total.

6. The cemented carbide according to claim 4, wherein a bainite phase and/or a martensite phase in said binder phase is 50% or more by area in total.

7. The cemented carbide according to claim 1, wherein said cemented carbide has compressive yield strength of 1200 MPa or more.

8. A rolling composite roll comprising an outer layer made of the cemented carbide recited in claim 1, said outer layer being metallurgically bonded to a peripheral surface of a steel sleeve or shaft.

9. A method for producing the cemented carbide recited in claim 1, comprising press-molding a mixture comprising 55-90 parts by mass of WC powder, and 10-45 parts by mass of metal powder comprising 2.5-10% by mass of Ni, 0.3-1.7% by mass of C, 0.5-5% by mass of Cr, 0.2-2.0% by mass of Si, 0-5% by mass of Co, and 0-2% by mass of Mn, the balance being Fe and inevitable impurities;

vacuum-sintering the resultant green body at a temperature from its liquid phase generation start temperature to said liquid phase generation start temperature+100° C.; and then cooling the resultant sintered body at a cooling rate of 60° C./hour or more between 900° C. and 600° C.

* * * * *